US007353909B2

(12) United States Patent
Kawahashi et al.

(10) Patent No.: US 7,353,909 B2
(45) Date of Patent: Apr. 8, 2008

(54) ACOUSTIC FLUID MACHINE

(75) Inventors: Masaaki Kawahashi, Saitama (JP); Tamotsu Fujioka, Yokohama (JP); Mohammed Anwar Hossain, Yokohama (JP); Masayuki Saito, Yokohama (JP)

(73) Assignee: Anest Iwata Corporation (JP)

( * ) Notice: Subject to any disclaimer, the term of this patent is extended or adjusted under 35 U.S.C. 154(b) by 309 days.

(21) Appl. No.: 11/162,397

(22) Filed: Sep. 8, 2005

(65) Prior Publication Data

US 2006/0054383 A1 Mar. 16, 2006

(30) Foreign Application Priority Data

Sep. 10, 2004 (JP) ..... 2004-263655

(51) Int. Cl.
*F01N 1/14* (2006.01)

(52) U.S. Cl. ..... 181/262; 62/6; 62/508

(58) Field of Classification Search ..... 181/262, 181/252, 220, 259, 250, 266, 276, 277, 278, 181/271, 198; 417/32; 381/87, 164, 397; 62/6, 508

See application file for complete search history.

(56) References Cited

U.S. PATENT DOCUMENTS 2,306,632 A * 12/1942 McCormack ..... 62/190
3,225,563 A * 12/1965 Braun ..... 62/277
3,972,651 A * 8/1976 Fletcher et al. ..... 417/141
4,118,943 A * 10/1978 Chellis ..... 62/6
4,139,991 A * 2/1979 Barats et al. ..... 62/6
5,174,130 A * 12/1992 Lucas ..... 62/498
5,284,022 A * 2/1994 Chung ..... 62/6
5,515,684 A * 5/1996 Lucas et al. ..... 62/6
6,804,967 B2 * 10/2004 Symko et al. ..... 62/6
7,252,178 B2 * 8/2007 Kawahashi et al. ..... 181/262
2004/0017924 A1 * 1/2004 Kuratani et al. ..... 381/349
2006/0054382 A1 * 3/2006 Kawahashi et al. ..... 181/262
2006/0054383 A1 * 3/2006 Kawahashi et al. ..... 181/262
2006/0144637 A1 * 7/2006 Swartz et al. ..... 181/198
2006/0185370 A1 * 8/2006 Watanabe et al. ..... 62/6
2006/0213720 A1 * 9/2006 Kawahashi et al. ..... 181/262

FOREIGN PATENT DOCUMENTS

JP 2004116309 A 4/2004

OTHER PUBLICATIONS

U.S. Appl. No. 10/922,383, filed Aug. 19, 2004, Kawahashi et al.

* cited by examiner

*Primary Examiner*—Lincoln Donovan
*Assistant Examiner*—Forrest Phillips

(57) ABSTRACT

A piston is reciprocated axially at high speed at very small amplitude by an actuator in the larger-diameter base of an acoustic resonator. According to pressure fluctuation in the acoustic resonator involved by reciprocal motion of the piston, fluid is sucked into and discharged from the acoustic resonator via a valve device at the top end of the acoustic resonator. The acoustic resonator is contained in a gas guide. Fluid from the valve device is introduced into the gas guide to cool the valve device.

9 Claims, 5 Drawing Sheets

10
8
5
6
4
2
1
16
9
3
7

11
8
5
6
4
2
1
16
9
3
7

11
8
5
12
6
4
2
1
16
9
3
7

11
8
5
13
4
2
1
6
16
9
3
7

11
8
5
13
4
2
15
14
1
6
16
9
3
7

ACOUSTIC FLUID MACHINE

BACKGROUND OF THE INVENTION

The present invention relates to an acoustic fluid machine which enables temperature gradient between a base having an actuator of acoustic resonator and the top end having a valve device for sucking and discharging fluid to be as small as possible.

As disclosed in U.S. patent application Ser. No. 10/922,383 filed Aug. 19, 2004 corresponding to Japanese Patent Pub. No. 2004-116309, there is provided an actuator that has a piston is provided in the base of a tapered acoustic resonator for generating in-tube wave motion by acoustic resonance, and a valve device for sucking and discharging fluid according to pressure fluctuation therein.

In the acoustic fluid machine, shape and size of the acoustic resonator are determined to generate the optimum resonance frequency when temperature of fluid is within a certain range. The optimum frequency renders the optimum sucking and discharging of fluid. Thus, if the resonance frequency is out of the certain range, compression ratio becomes smaller to make it impossible to achieve desired discharge pressure.

The resonance frequency varies with change in temperature of a resonator. By calculating resonance frequency, frequency of an actuator for the piston is changed to comply with the resonance frequency, thereby exhibiting desired sucking/discharging performance.

So it is necessary to change the actuator for the piston using arithmetic machine, which makes its structure more complicate and expensive.

Temperature in the acoustic resonator of the acoustic fluid machine is higher in the closed top end or at the valve device, while it is lower in the piston and actuator which generally opens to make temperature gradient larger. If the temperature gradient in the acoustic resonator is as small as possible, it will not be out of the determined resonance frequency or its deviation is as small as possible to render it within normal compression range.

SUMMARY OF THE INVENTION

In view of the disadvantages, it is an object of the present invention to provide an acoustic fluid machine in which temperature gradient between the base and top end of an acoustic resonator is as small as possible.

BRIEF DESCRIPTION OF THE DRAWINGS

The features and advantages of the invention will become more apparent from the following description with respect to embodiments as shown in appended drawings wherein.

DETAILED DESCRIPTION OF PREFERRED EMBODIMENT

Figure 1:
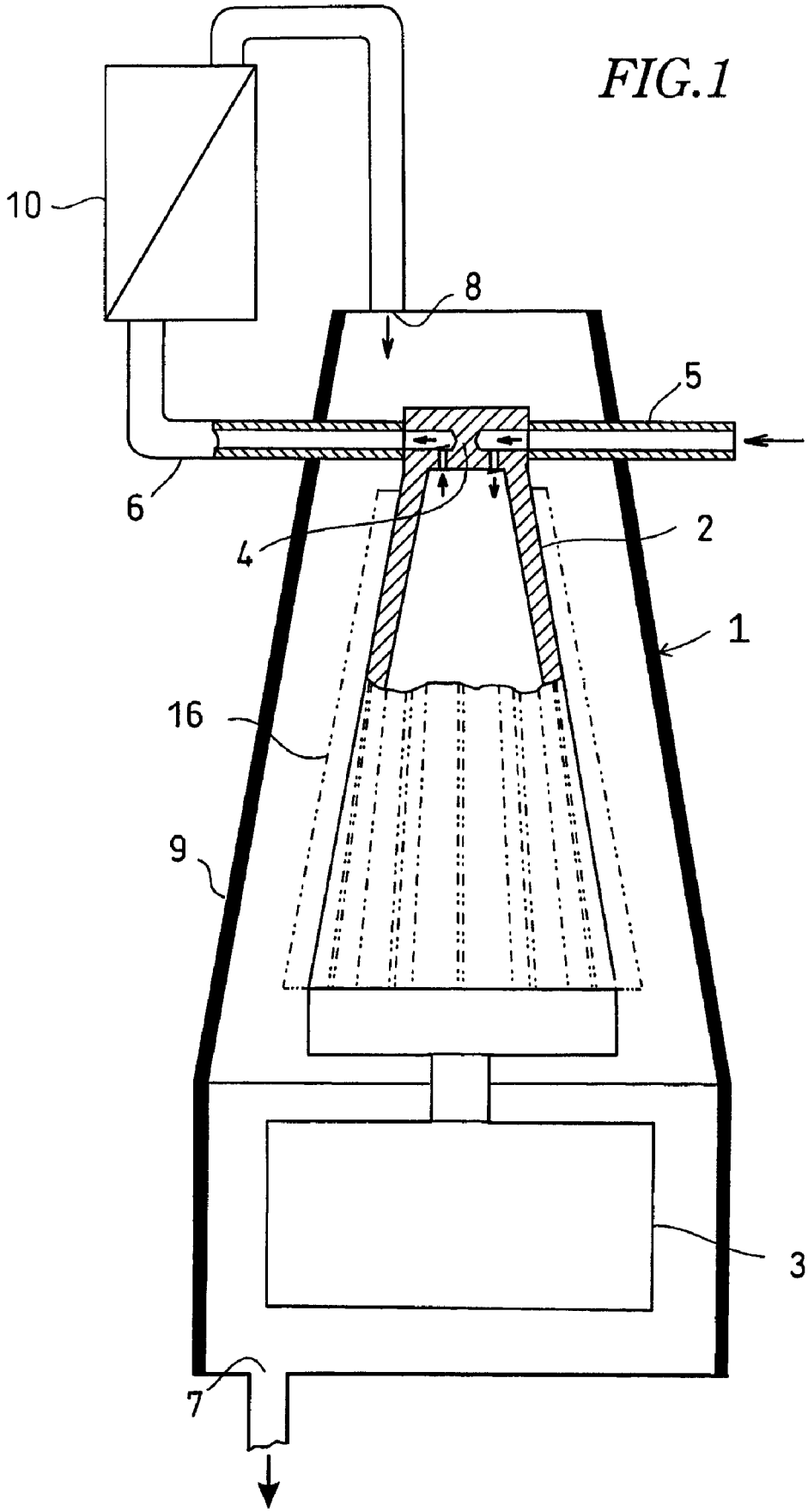
FIG. 1 is a vertical sectional front view of an embodiment of an acoustic fluid machine according to the present invention.

Numeral 1 denotes an acoustic fluid machine 1. In a larger-diameter base of an acoustic resonator 2, there is provided a piston (not shown) which reciprocates axially at high speed at very small amplitude. Owing to pressure fluctuation in the acoustic resonator 2 involved by reciprocal motion of the piston, air or other fluids are sucked from a sucking pipe 5 via a valve device 4 at the top end of the acoustic resonator 2, and discharged from a discharge pipe 6.

The acoustic resonator 2 is contained in a gas guide 9 having an outlet 7 at the base end and an inlet 8 at the top end with a gap.

FIG. 1 shows an embodiment in which the discharge pipe 6 of the valve device 4 is connected to the inlet 8 via an air conditioner 10 which cool air.

Figure 2:
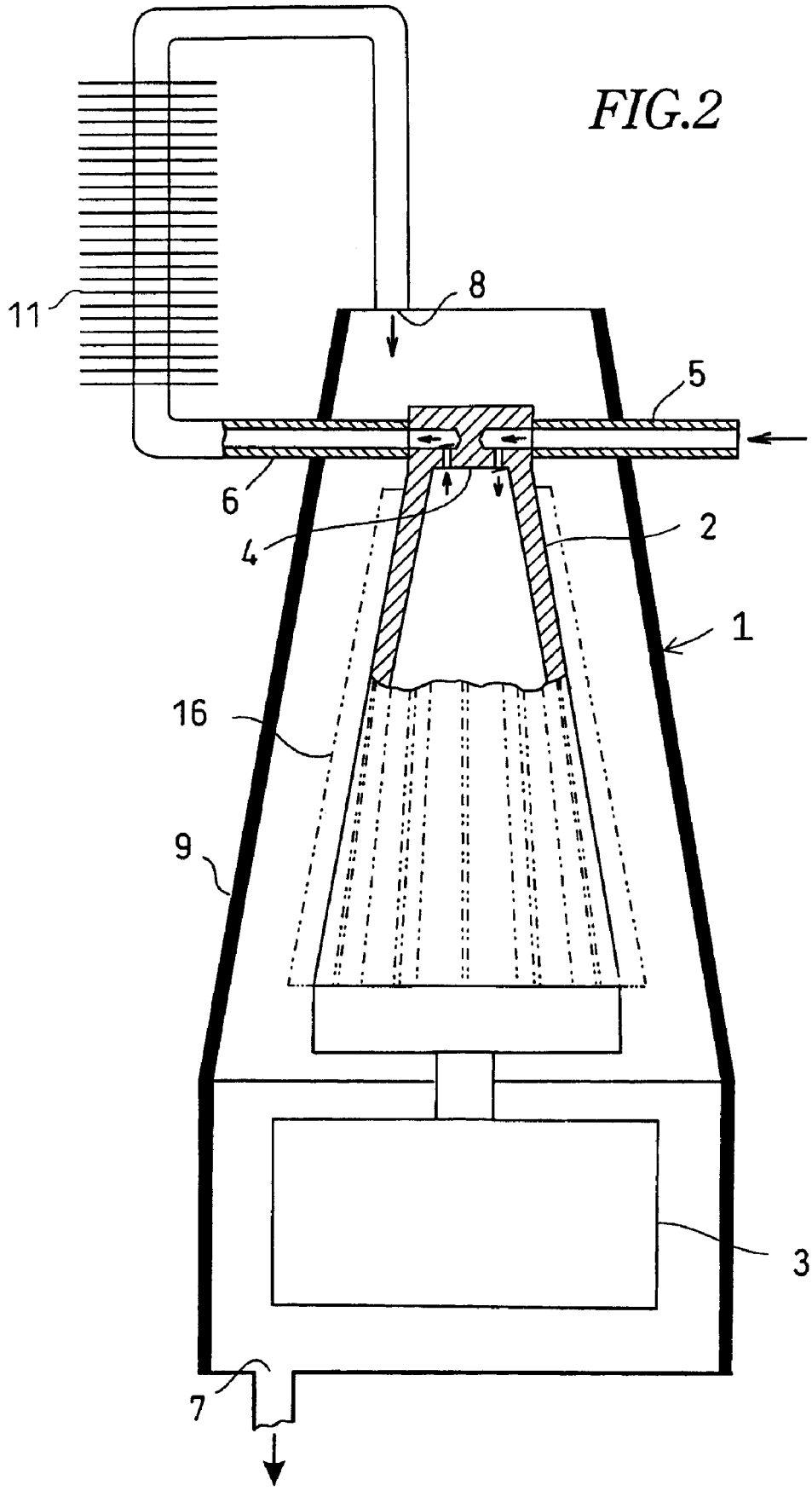
FIG. 2 is a vertical sectional front view of another embodiment of an acoustic fluid machine according to the present invention.

In FIG. 2, instead of the air conditioner 10 connected to the discharge pipe 6, cooling fins 11 are provided on the discharge pipe 6.

Figure 3:
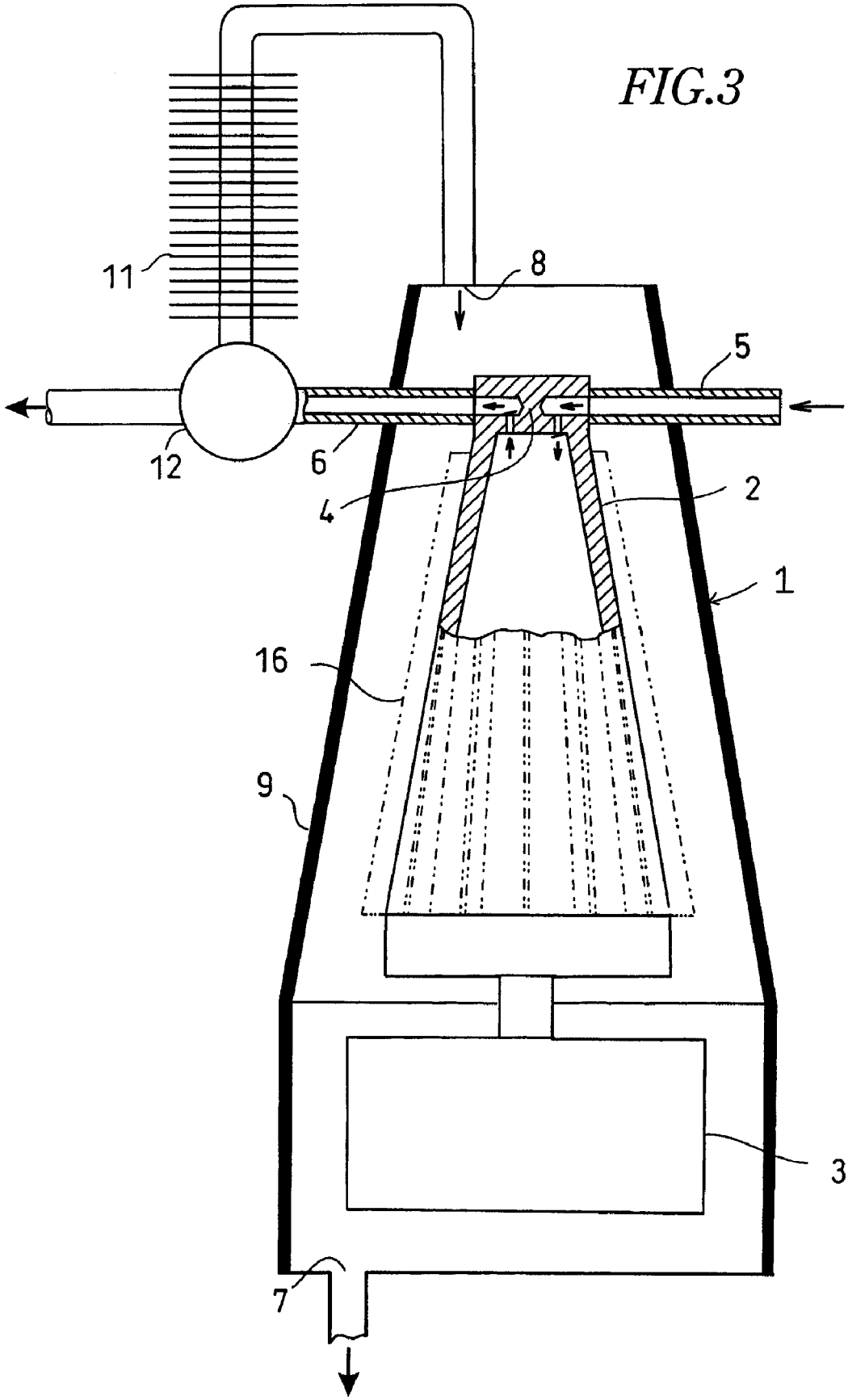
FIG. 3 is a vertical sectional front view of yet another embodiment of an acoustic fluid machine according to the present invention.

In FIG. 3, there is provided a dividing valve 12 on the discharge pipe 6 from the valve device 4. A discharged pressurized gas is partially divided into the inlet 8 of the gas guide 9.

Figure 4:
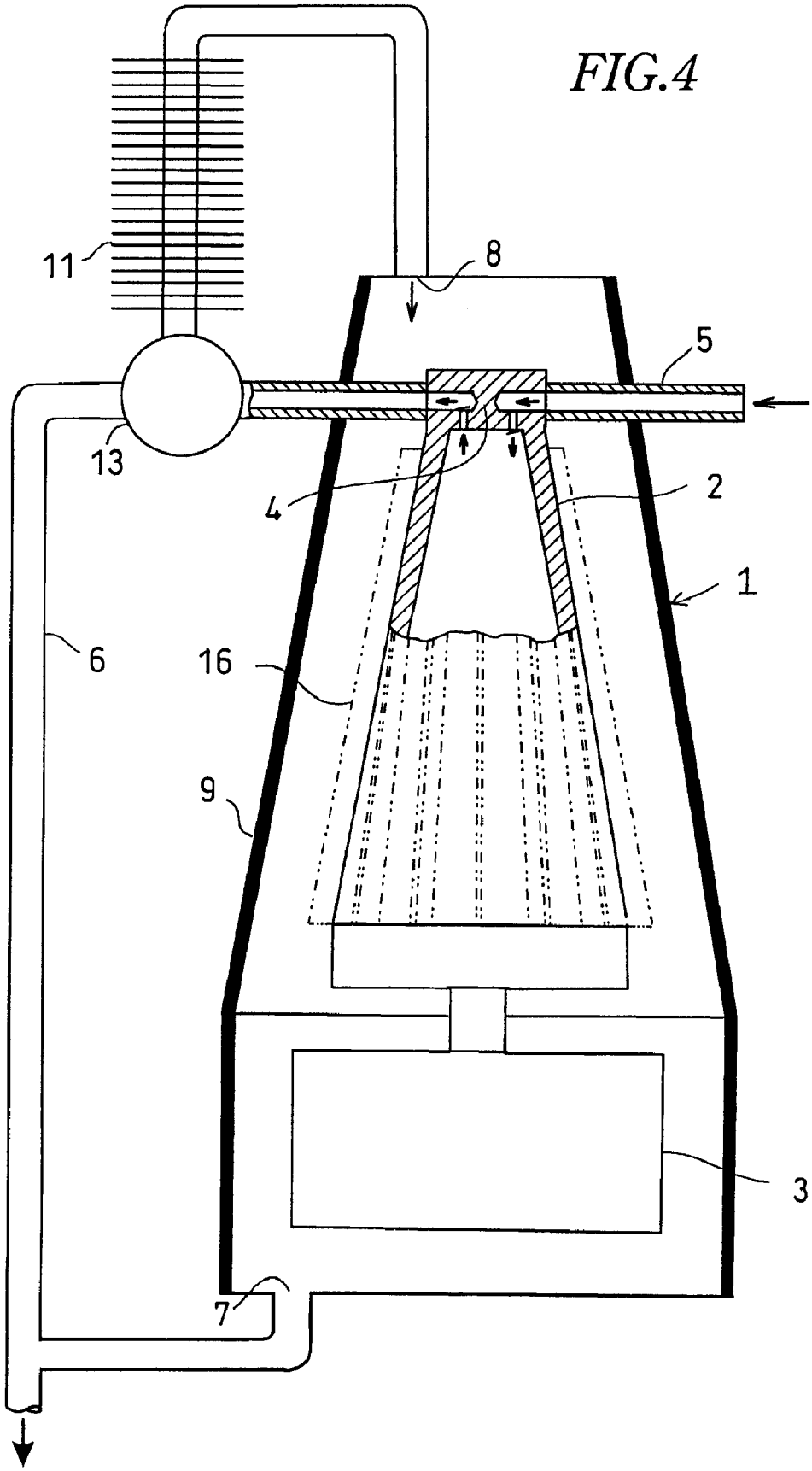
FIG. 4 is a vertical sectional front view of a further embodiment of an acoustic fluid machine according to the present invention.

In FIG. 4, there is provided a regulation dividing valve 13 operated manually or by any other means on the discharge pipe 6 from the valve device 4. If necessary, a desired amount of discharged pressurized gas is divided into the gas guide 9. The outlet 7 of the gas guide 9 is connected to the discharge pipe 6, so that a discharged gas in the gas guide 9 is gathered to the outlet 6 to allow the gas to be used effectively. If it is difficult to gather the gas into the outlet 6 suitably, a check valve or an injector is connected.

Figure 5:
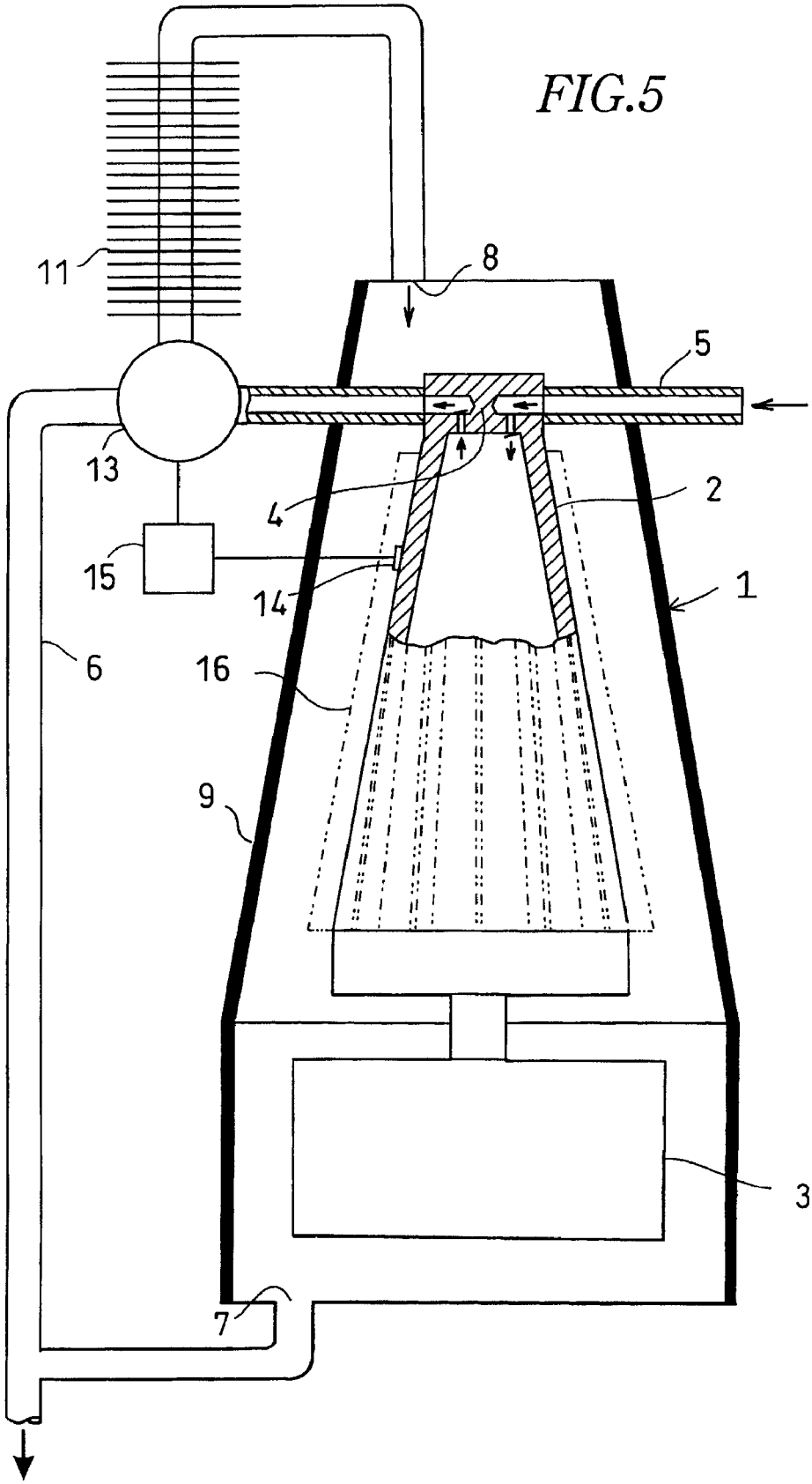
FIG. 5 is a vertical sectional front view of a yet further embodiment of an acoustic fluid machine according to the present invention.

In FIG. 5, degree of opening or ratio of dividing in the regulating dividing valve 13 is controlled by a control unit 15 according to measured value in a temperature sensor 14 on the acoustic resonator 2.

In any one of FIGS. 1 to 4, heat-releasing fins 16 may be preferably provided on the outer circumferential surface of the acoustic resonator 2 in the gas guide 9.

The foregoing merely relates to embodiments of the invention. Various changes and modifications may be made by a person skilled in the art without departing from the scope of claims.

What is claimed is:

1. An acoustic fluid machine comprising:

an acoustic resonator;

an actuator in a larger-diameter base of the acoustic resonator to allow a piston to reciprocate axially at high speed at very small amplitude;

a valve device at a top end of the acoustic resonator to allow fluid to suck into and discharge from the acoustic resonator owing to pressure fluctuation in the acoustic resonator involved by reciprocal motion of the piston; and a gas guide for covering the acoustic resonator, said gas guide having an inlet at a top end and an outlet at a base, the fluid from the valve device being introduced into the gas guide via the inlet to cool the valve device, and discharged from the outlet.

2. An acoustic fluid machine of claim 1 wherein the fluid is introduced into the acoustic resonator via the valve device from a sucking pipe and discharged from the acoustic resonator via the valve device to a discharge pipe.

3. An acoustic fluid machine of claim 2 wherein the fluid discharged from the valve device is cooled before introducing into the gas guide via the inlet.

4. An acoustic fluid machine of claim 3 wherein the fluid from the valve device is cooled by an air conditioner connected to the discharge pipe.

5. An acoustic fluid machine of claim 3 wherein the fluid discharged from the valve device is cooled by a cooling fin on the discharge pipe.

6. An acoustic fluid machine of claim 1 wherein a dividing valve is provided on the discharge pipe to allow the fluid from the valve device to forward the inlet of the acoustic resonator partially.

7. An acoustic fluid machine of claim 6 wherein the dividing valve comprises a regulating dividing valve to regulate amount of the fluid introduced into the acoustic resonator.

8. An acoustic fluid machine of claim 6 wherein fluid discharged from the acoustic resonator via the outlet is gathered with the fluid flowing in the discharge pipe.

9. An acoustic fluid machine of claim 6 wherein dividing ratio of the fluid in the dividing valve is controlled by a temperature sensor on an outer circumferential surface of the acoustic resonator.

* * * * *